United States Patent [19]

Yeo

[11] 4,257,139

[45] Mar. 24, 1981

[54] PLUMBING SNAKE-HOSE ATTACHMENT

[76] Inventor: Claude E. Yeo, 8501 Croydon, Los Angeles, Calif. 90045

[21] Appl. No.: 31,825

[22] Filed: Apr. 20, 1979

[51] Int. Cl.[3] ..... B08B 9/02

[52] U.S. Cl. ..... 15/104.3 SN; 134/167 C

[58] Field of Search ..... 15/104.3 R, 104.3 SN, 15/104.12; 134/167 C, 168 C

[56] References Cited

U.S. PATENT DOCUMENTS

| | | | |
|---|---|---|---|
| 2,568,347 | 9/1951 | Lundelius | 134/167 C X |
| 2,608,421 | 8/1952 | Schnepp | 15/104.3 SN X |
| 3,959,840 | 6/1976 | Sato | 15/104.3 SN |

FOREIGN PATENT DOCUMENTS

| | | | |
|---|---|---|---|
| 1032961 | 6/1958 | Fed. Rep. of Germany | 134/167 C |

*Primary Examiner*—Edward L. Roberts

*Attorney, Agent, or Firm*—Edward A. Sokolski

[57] ABSTRACT

A section of hose which can be connected to the end of a normal hose line has a pressure nozzle in the end thereof opposite the attachment end. Fitted into this pressure nozzle is a coiled wire plumbing snake member having a water channel formed in the center thereof and a bulb at the free end thereof. The snake member operates in cooperation with the water stream which passes through the center thereof and which is sprayed out through the pressure nozzle to unplug foreign matter from plumbing pipes and drain lines and to clean the inner walls of such pipes and lines.

4 Claims, 5 Drawing Figures

PLUMBING SNAKE-HOSE ATTACHMENT

This invention relates to plumbing snakes, and more particularly to such a device having means therein for providing a water stream directly at the end of the snake.

Plumbing snakes are commonly in use for routing out foreign material from plumbing pipes and the like. One of the drawbacks of many of these snakes is that it often becomes difficult or impossible to thoroughly loosen clogging material strictly by the application of mechanical pressure. To remedy this situation, a pressurized water stream is sometimes employed in conjunction with the mechanical action of the snake. Prior art devices along these lines are described in the following U.S. patents: No. 2,797,423 to Rizor; No. 2,753,876 to Kurt; No. 3,937,404 to Johnson; No. 2,976,191 to Weston; No. 3,195,548 to Lestakis; No. 2,568,347 to Lundelius; and No. 3,616,479 to De Hart. In all of these devices but the one shown in the patent to Lestakis, a mechanical driver and a nozzle are incorporated into a common unit and the snake is not forward of the pressure nozzle where it can do the most good in initially partially clearing the way. In the Lestakis patent, a plurality of yieldable spherical plastic balls are mounted on a spring at the head of the hose with the water stream being fed solely through the spring, this spring being described as being free between the balls. Thus, while Lestakis has a member which runs in advance of the water stream, this advance member is yieldable and does not provide good mechanical action for clearing a blockage. Further, the water stream is fed strictly through the center of the spring and there is no pressure nozzle provided to effectively pressurize the stream.

The device of the present invention overcomes the aforementioned shortcomings of plumbing snakes using water streams in that it affords an optimum combination of mechanical and hydraulic action for efficiently breaking up a blockage and clearing the pipe thoroughly. This end result is achieved by employing a snake member which runs forward of the hose which has enough resiliency to go around bends but nevertheless sufficient rigidity and mechanical strength to be effective at least partially, if not completely, in clearing blockages. Hydraulic clearing force is also provided by means of a pressure nozzle which follows behind the mechanical snake member, the water stream also being fed through the center of the mechanical snake to provide a second water stream which issues from the snake at the head portion thereof. The two hydraulic water streams operate in conjunction with the mechanical snake member to provide highly effective action against blockages. This end result is achieved in a structure which is of relatively simple and economical construction which lends itself to long-time, trouble-free use.

It is therefore an object of this invention to provide an improved snake member employing combined mechanical and hydraulic force for clearing a blockage in a plumbing pipe or the like.

It is a further object of this invention to provide an improved plumbing snake which employs both hydraulic and mechanical force at its head portion along with hydraulic action which emanates from a position behind the head portion.

Other objects of this invention will become apparent as the description proceeds in connection with the accompanying drawings of which:

Figure 1:
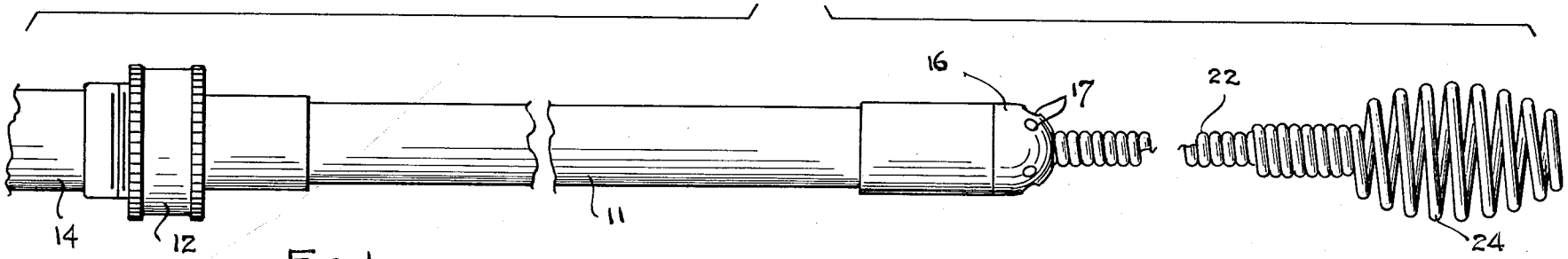
FIG. 1 is a side elevational view of a preferred embodiment of the invention.
Figure 3:
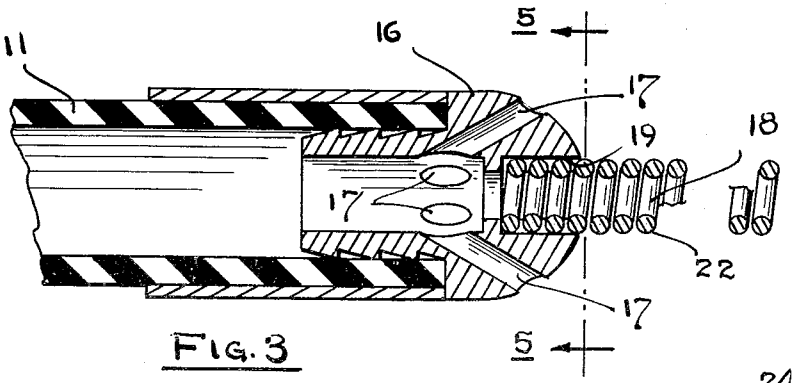
FIG. 3 is a cross-sectional view illustrating the pressure nozzle of the preferred embodiment.
Figure 4:
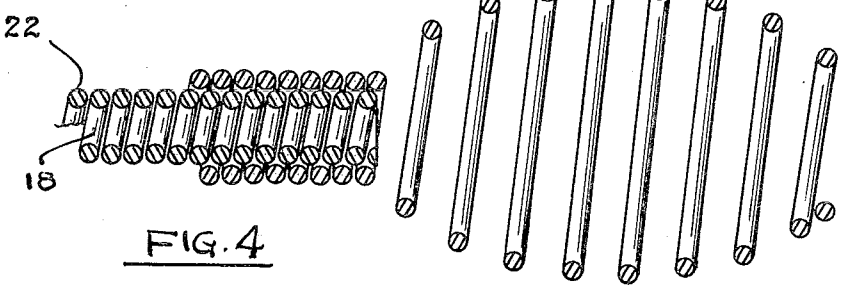
FIG. 4 is a cross-sectional view of the head portion of the preferred embodiment.
Figure 2:
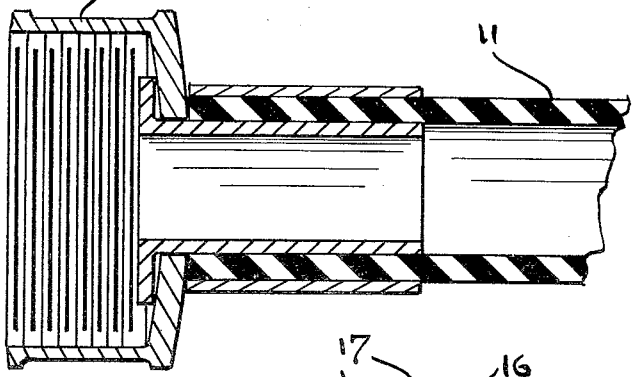
FIG. 2 is a cross-sectional view showing the connector portion of the preferred embodiment.
Figure 5:
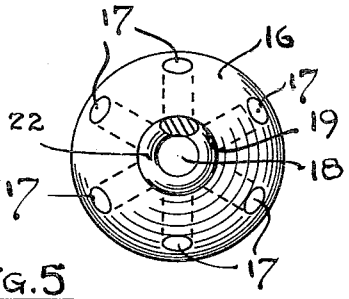
FIG. 5 is a view taken along the plane indicated by 5—5 in FIG. 3.

Referring now to the figures, a flexible hose section 11 which typically may be made of a suitable plastic material and typically is of the order of 6 feet in length has a female hose connector 12 on one end thereof which is used for connecting the hose section to an ordinary hose line 14. Press-fitted onto the opposite end of hose section 11 is a pressure nozzle 16 which has a plurality of radial outlet apertures 17 through which a pressurized stream of water is emitted. Nozzle 16 also has a central aperture 18. A cylindrical recess 19 is formed in the tip of nozzle 16, aperture 18 providing fluid communication between this recess and the central interior portion of the nozzle. Fitted in recess 19 is the end portion of wound wire snake member 22 which has a head portion at the opposite leading end thereof. The end of snake member 22 which is fitted into the nozzle is fixedly attached to the nozzle by welding, soldering or other suitable means.

In operation, the head portion 24 of mechanical snake member 22 is fed into the plumbing pipe to be cleared by means of hose section 11 and main hose line 14 with the water stream simultaneously being fed from hose 14 to those section 11. A portion of the water stream runs from the hose section through the center of snake member 22 and issues from this member at the head portion 24 thereof which is in the form of a bulb. The remainder of the water is ejected out of nozzle 16 through the radial outlets 17 thereof. In this manner, the dual action of a first water stream which appears behind the snake head at nozzle 16 is provided. This hydraulic action combined with the mechanical action of the snake member is highly effective in clearing even difficult blockages. In a typical operative embodiment of the invention, snake member 22 is of the order of 15 inches in length, while hose section 11, as already noted, is of the order of six feet.

While the invention has been described and illustrated in detail, it is to be clearly understood that this is intended by way of illustration and example only and is not to be taken by way of limitation, the spirit and scope of this invention being limited only by the terms of the following claims.

I claim:

1. A plumbing snake device for attachment to a water hose for use in clearing a plumbing line by simultaneous water action and mechanical action comprising a hose section connected at one end thereof to said water hose, a pressure nozzle connected to the other end of said hose section, said pressure nozzle having a central aperture and a plurality of radial apertures which are substantially smaller than said central aperture for emitting a pressurized radial water stream, and a snake member having a central channel formed therein, one end of said snake member being attached to said pressure nozzle with the central channel thereof in fluid communication with the central aperture of said nozzle, a head portion on the opposite end of said snake member, said opposite end providing an outlet for said channel, whereby a first radially directed pressurized water stream is provided through the radial apertures of said pressure nozzle aft of the snake member and a second axially directed water stream is provided from the opposite end of the snake member forward of the nozzle.

2. The snake device of claim 1 wherein the head portion of said snake member is in the form of a bulb.

3. The snake device of claim 1 wherein said nozzle has a recess formed therein into which said one end of the snake member is fitted.

4. The snake device of claim 1, 2 or 3 wherein said snake member is formed from wire which is tightly wound cylindrically to form said channel.

* * * * *